US007383840B2

(12) United States Patent
Coleman

(10) Patent No.: US 7,383,840 B2
(45) Date of Patent: Jun. 10, 2008

(54) APPARATUS FOR SCANNING AND SORTING TOBACCO LEAVES

(75) Inventor: G. A. John Coleman, Richmond, VA (US)

(73) Assignee: Universal Leaf Tobacco Company, Inc., Richmond, VA (US)

( * ) Notice: Subject to any disclaimer, the term of this patent is extended or adjusted under 35 U.S.C. 154(b) by 479 days.

(21) Appl. No.: 11/078,724

(22) Filed: Mar. 14, 2005

(65) Prior Publication Data

US 2005/0199252 A1 Sep. 15, 2005

Related U.S. Application Data

(60) Provisional application No. 60/552,742, filed on Mar. 15, 2004, provisional application No. 60/561,519, filed on Apr. 13, 2004.

(51) Int. Cl.
*A24C 1/28* (2006.01)

(52) U.S. Cl. ..... 131/110; 131/108; 131/905

(58) Field of Classification Search ..... 131/108, 131/110, 905, 109.1, 304, 306; 209/638, 209/639, 644

See application file for complete search history.

(56) References Cited

U.S. PATENT DOCUMENTS

| | | | |
|---|---|---|---|
| 2,131,095 | A | 9/1938 | Cox |
| 2,173,087 | A | 9/1939 | Eissmann |
| 2,267,326 | A | 12/1941 | Eissmann |
| 2,645,343 | A | 7/1953 | Nemir |
| 3,549,008 | A | 12/1970 | Anderson |
| 3,593,851 | A | 7/1971 | Davidson |
| 3,608,716 | A | 9/1971 | Rowell et al. |
| 3,685,650 | A | 8/1972 | Walther et al. |
| 3,750,882 | A | 8/1973 | Hays |
| 3,770,112 | A | 11/1973 | Asfour |
| 3,782,544 | A | 1/1974 | Perkins, III |
| 3,854,586 | A | 12/1974 | Perkins, III |

(Continued)

FOREIGN PATENT DOCUMENTS

| | | | |
|---|---|---|---|
| DE | 3428966 | A | 2/1986 |

(Continued)

*Primary Examiner*—Carlos Lopez
(74) *Attorney, Agent, or Firm*—Pillsbury Winthrop Shaw Pittman LLP

(57) ABSTRACT

An apparatus for scanning and sorting tobacco leaves includes a conveyor to convey a flow of tobacco leaves. The flow of tobacco leaves includes acceptable and unacceptable leaves and undesirable particles. An air flow source lifts and accelerates the flow of leaves and particles to a speed at which the leaves and particles are separated. A duct contains the lifted and accelerated flow. A scanning device scans the flow in the duct and generates a signal upon detection of an unacceptable leaf and/or undesirable particle. A rejection device responds to the signal and forces the unacceptable leaf and/or undesirable particle from the duct. A method of scanning and sorting tobacco leaves includes conveying a flow of tobacco leaves including acceptable and unacceptable leaves and undesirable particles, lifting and accelerating the flow to a speed at which the leaves and particles are separated, scanning the separated leaves and particles to detect unacceptable leaves and undesirable particles, and forcing unacceptable leaves and/or undesirable particles from the accelerated flow of leaves. The flow may be accelerated to a speed of between 4,000-6,000 ft/min. The scanning device may be an optical or laser scanning device that scans the flow between 2,000-12,000 times per second.

25 Claims, 3 Drawing Sheets

U.S. PATENT DOCUMENTS 3,917,070 A 11/1975 Asfour
3,928,183 A 12/1975 Asfour
3,939,983 A 2/1976 Asfour
3,968,366 A 7/1976 Asfour
4,018,674 A 4/1977 Morris
4,465,194 A * 8/1984 Coleman ..... 209/639
4,475,562 A 10/1984 Thatcher et al.
4,609,108 A 9/1986 Hristozov et al.
4,657,144 A 4/1987 Martin et al.
4,701,256 A 10/1987 Cross, Jr.
4,729,388 A 3/1988 Mattei
4,867,179 A * 9/1989 Leonard ..... 131/96
4,875,495 A 10/1989 Wheless
4,883,077 A 11/1989 Irigoyen
4,895,174 A 1/1990 Henderson et al.
4,938,235 A * 7/1990 Hirsch et al. ..... 131/110
4,941,482 A * 7/1990 Heitmann et al. ..... 131/84.4
4,971,077 A 11/1990 Dominguez et al.
4,991,598 A 2/1991 Henderson et al.
5,063,944 A 11/1991 Parker
5,090,576 A 2/1992 Menten
5,099,863 A 3/1992 Coleman
5,188,127 A 2/1993 Heitmann
5,199,448 A 4/1993 Parker
5,205,415 A 4/1993 Surtees
5,267,576 A 12/1993 Heitmann
5,267,578 A 12/1993 Brackmann et al.
5,294,218 A 3/1994 Fiorentini et al.
5,325,875 A 7/1994 Coleman et al.
5,331,978 A 7/1994 Parker
5,358,122 A 10/1994 Surtees
5,388,704 A 2/1995 Morris
5,394,893 A 3/1995 Coleman et al.
5,427,248 A 6/1995 Levy et al.
5,460,189 A 10/1995 Coleman et al.
5,462,176 A 10/1995 Hereford et al.
5,476,108 A 12/1995 Dominguez et al.
5,476,109 A 12/1995 Coleman et al.
5,538,017 A 7/1996 Webb et al.
5,967,146 A 10/1999 Orihara et al.
6,003,681 A 12/1999 Wilbur et al.
6,019,105 A 2/2000 White
6,332,543 B1 12/2001 Niehues et al.
6,435,191 B1 8/2002 Roudabush et al.
6,542,234 B1 4/2003 Ulrich et al.
6,768,317 B2 * 7/2004 Moller et al. ..... 324/637
6,877,515 B2 * 4/2005 Heitmann et al. ..... 131/84.2
2002/0130067 A1 9/2002 Takai et al.
2002/0162561 A1 11/2002 Heitmann

FOREIGN PATENT DOCUMENTS

EP 1188385 A1 3/2002
WO WO 90/06819 6/1990
WO WO 03/090569 A1 11/2003

* cited by examiner

APPARATUS FOR SCANNING AND SORTING TOBACCO LEAVES

CROSS REFERENCE TO RELATED APPLICATIONS

This application claims priority under 35 U.S.C. § 119(e) (1) to U.S. application Ser. No. 60/552,742, filed Mar. 15, 2004 and U.S. application Ser. No. 60/561,519, filed Apr. 13, 2004, the entire contents of which are incorporated herein by reference.

BACKGROUND OF THE INVENTION

1. Field of the Invention

The present invention relates to apparatus and methods for scanning and sorting tobacco leaves. More particularly, the present invention relates to apparatus and methods for processing tobacco leaves by scanning the leaves and removing unacceptable leaves and other contaminants that are detected.

2. Description of the Related Art

Tobacco leaves obtained from farmers include discolored or damaged leaves and other contaminants which must be removed during the initial processing of the tobacco. Initial processing of tobacco leaves includes dividing the flow of tobacco over many slow moving conveyors. One or more inspectors were stationed at each conveyor to visually inspect each leaf and manually remove undesirable leaves and other contaminants, such as stems, stone, or portions of latex gloves used by tobacco leaf harvesters. This system of initial processing was costly as it required a lot of space, equipment and manpower. The system was also inefficient and inconsistent because the inspectors are unable to give full attention to every leaf and particle, despite the generally slow moving conveyors. The system also relied on the subjective judgment of the inspectors to identify and remove discolored or damaged leaves and other contaminants.

Machines were developed in the early 1970's to scan the flow of tobacco leaves on the multiple conveyors. The machines scanned the flow using light at different wavelengths. The machines were able to detect and reject different colors, as selected by the operators. Although the machines performed adequately, they were subject to changes in the light source, effects of ambient lighting, shadows and drift of the calibration parameters, which resulted in inconsistent performance. The machines were largely abandoned in the 1980's and human inspectors returned at a reduced level.

Technology improved in the 1990's and more efficient and consistent scanning devices were developed. These scanning devices used traditional optics with independent light sources and lasers. The scanning devices are used in many industries, and proved successful in scanning strip-tobacco and stems. However, each device is extremely expensive.

A need exists for a machine for scanning tobacco leaves to reject unacceptable (e.g., discolored or damaged) leaves and/or other undesirable particles before they are threshed into multiple small pieces. To divide the product over multiple conveyors in order to thin the flow enough so that each leaf can be viewed individually would require 50-100 machines per plant. The conveyor speed would also be limited because beyond a certain speed the leaves become airborne and cease to be conveyed. The cost of this many machines, the slow processing speed, and the space required would make plant construction and operation prohibitively expensive.

SUMMARY OF THE INVENTION

One aspect of the present invention is an apparatus for scanning and sorting tobacco leaves including a conveyor configured to convey a flow of tobacco leaves. The flow of tobacco leaves includes acceptable leaves, unacceptable leaves, and undesirable particles or contaminants. An air flow source is configured to lift and accelerate the flow of leaves and particles or contaminants to a speed at which the leaves and the particles are separated. A duct is configured to contain the lifted and accelerated flow of leaves and particles and a scanning device is configured to scan the flow of leaves and particles in the duct and generate a signal upon detection of an unacceptable leaf and/or an undesirable particle. A rejection device is responsive to the signal and configured to force unacceptable leaves and/or undesirable particles from the duct. According to one exemplary embodiment of the present invention, the rejection device includes at least one solenoid valve configured to receive the signal and release compressed air from a compressed air source upon receipt of the signal to force the unacceptable tobacco leaves and the undesirable particles from the duct. According to another exemplary embodiment of the present invention, the rejection device includes a flap configured to be selectively insertable into the flow to direct unacceptable leaves and/or undesirable particles from the duct.

According to another aspect of the present invention, leaves forced from the duct are scanned by a second scanning device and unacceptable leaves are removed and acceptable leaves passing the second scanning device are conveyed and combined with leaves passing the compressed air source.

According to a still further aspect of the present invention, the tobacco leaves are accelerated to a speed of approximately 4,000-6,000 ft/min in order to separate the leaves from each other and any undesirable particles.

According to an even further aspect of the present invention, the scanning devices are optical or lasing scanning devices. The scanning device scans the leaves and particles in the duct between 2,000-12,000 times per second.

According to yet another aspect of the present invention, a method of scanning and sorting tobacco leaves includes conveying a flow of tobacco leaves, the flow of leaves including acceptable leaves, unacceptable leaves and undesirable particles, lifting and accelerating the flow of leaves and particles to a speed at which the leaves and particles are separated, scanning the separated leaves and particles to detect unacceptable leaves and undesirable particles, and forcing unacceptable leaves and undesirable particles from the accelerated flow of leaves and particles.

BRIEF DESCRIPTION OF THE DRAWINGS

Exemplary embodiments of the present invention will now be described with reference to the accompanying schematic drawings in which.

DETAILED DESCRIPTION

Figure 1:
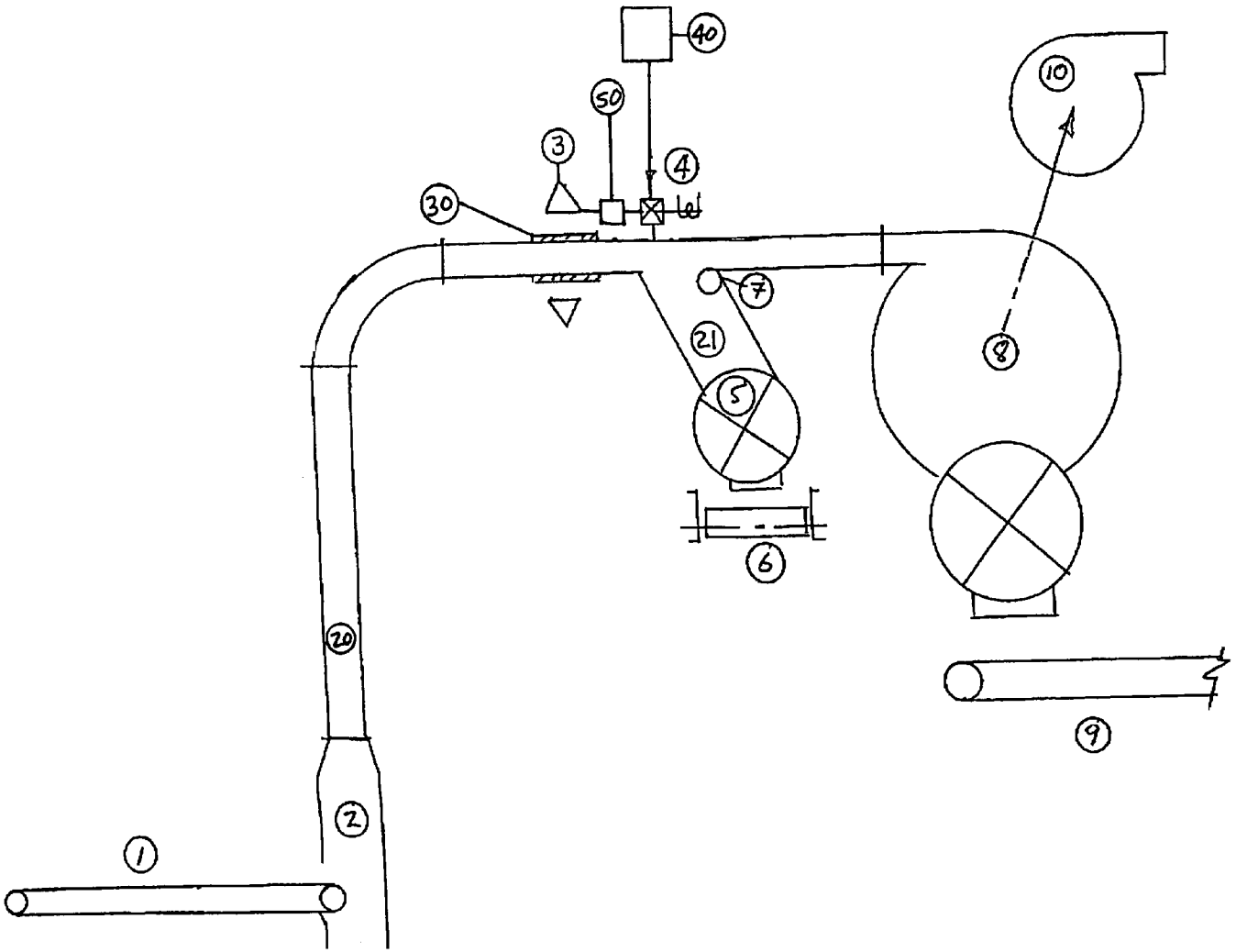
FIG. 1 is a side elevation view of an apparatus for scanning and sorting tobacco leaves according to an exemplary embodiment of the present invention.

Referring to FIG. 1, the apparatus of the present invention includes a conveyor 1. Tobacco leaves are supplied to the conveyor 1 from blending silos or other device after an initial conditioning process. The tobacco is divided into flows of 10,000-15,000 lb/hour by known apparatus and methods. Each flow includes tobacco leaves and other particles and/or contaminants. The flow is directed to the conveyor 1, which may be for example, an endless belt-type conveyor. It should be appreciated that other types of conveyors may be used. In a preferred embodiment, the conveyor 1 is 72 inches wide and travels approximately 250 ft/min to provide a "carpet" of tobacco leaves about 1-2 inches deep.

The flow is delivered by the conveyor 1 to an air flow source 2. In the air flow source 2, an upward current of air lifts the flow of tobacco leaves. Some undesirable particles or contaminants heavier than tobacco leaves, such as metal or rocks, are not lifted by the current and drop out of the flow. Other undesirable particles and/or contaminants may be lifted with the upward current of air and be conveyed with leaves. In the duct 20 leading from the air flow source 2, the flow of tobacco leaves is accelerated to a speed sufficient to separate the individual leaves from each other and from any undesirable particles. In a preferred embodiment, the flow of tobacco leaves is accelerated to a speed of approximately 4,000-6,000 ft/min. Accelerating the flow of tobacco to this speed permits a loading and processing of approximately 2,000-3,000 lb/hr per foot width of the apparatus.

Although the duct 20 is shown extending vertically from the air source 2, it should be appreciated that the duct 20 may be at angle to the air source 2, and may even extend horizontally from the air source 2. It should also be appreciated that the duct 20 may have any cross-sectional shape and have a length sufficient for the acceleration of the flow to a speed at which the individual tobacco leaves are separated.

The individual, separated tobacco leaves and undesirable particles are scanned by a laser or optical scanning device 3. It should be appreciated that more than one scanning device 3 may be provided. The duct 20 may be formed of a transparent plastic or glass material so that the scanning device 3 can detect the tobacco leaves and particles through the duct 20. The duct 20 may also be formed of non-transparent material, such as metal, and have transparent portions 30 provided at the position of the scanning device 3 so that the tobacco leaves may be detected by the scanning device 3. The transparent portions 30 may be provided on opposite sides of the duct or may be provided around the entire circumference of the duct 20.

Any unacceptable, e.g., discolored or damaged, leaves or other particles which do not meet the acceptance criteria are detected by the scanning device 3 and signals are sent to solenoid valves 4. As the solenoid valves 4 open, they direct a blast of compressed air from a compressed air source 40 at the unacceptable leaf or particle. The solenoid valves 4 are provided across the width of the duct 20. Although the scanning device 3, solenoid valves 4 and compressed air source 40 are shown at a generally horizontal portion of the duct, it should be appreciated that the scanning device 3, solenoid valves 4 and compressed air source 40 may be provided along a generally vertical portion of the duct 20.

The solenoid valves 4 are controlled by a programmable control device 50 that receives the signals from the scanning device 3 and controls the actuation (i.e., energization) of the solenoid valves 4. The programmable control device 50 comprises software and is programmed to take into account the velocity of the tobacco leaves in the duct 20 and the time at which the solenoid valves 4 are opened and also controls the duration of the valve opening when the solenoid valves 4 direct a burst of compressed air at an unacceptable leaf and/or object.

The compressed air forces the unacceptable leaf or particle out of the duct 20 and into a chute 21 that leads to an airlock 5. From the airlock 5, the unacceptable leaf and/or particle is discharged onto a second conveyor 6. In order to prevent unacceptable leaves and/or particles from being trapped at the juncture between the duct 20 and the chute 21, the juncture is provided with a roller 7. The roller 7 is rotated so that it moves trapped, rejected leaves and/or particles into the chute 21. It should be appreciated that the roller 7 may be a rotatable vane or plate. It should be appreciated that plural sets of solenoid valves, chutes, and rollers/vanes/plates may be provided.

Figure 2:
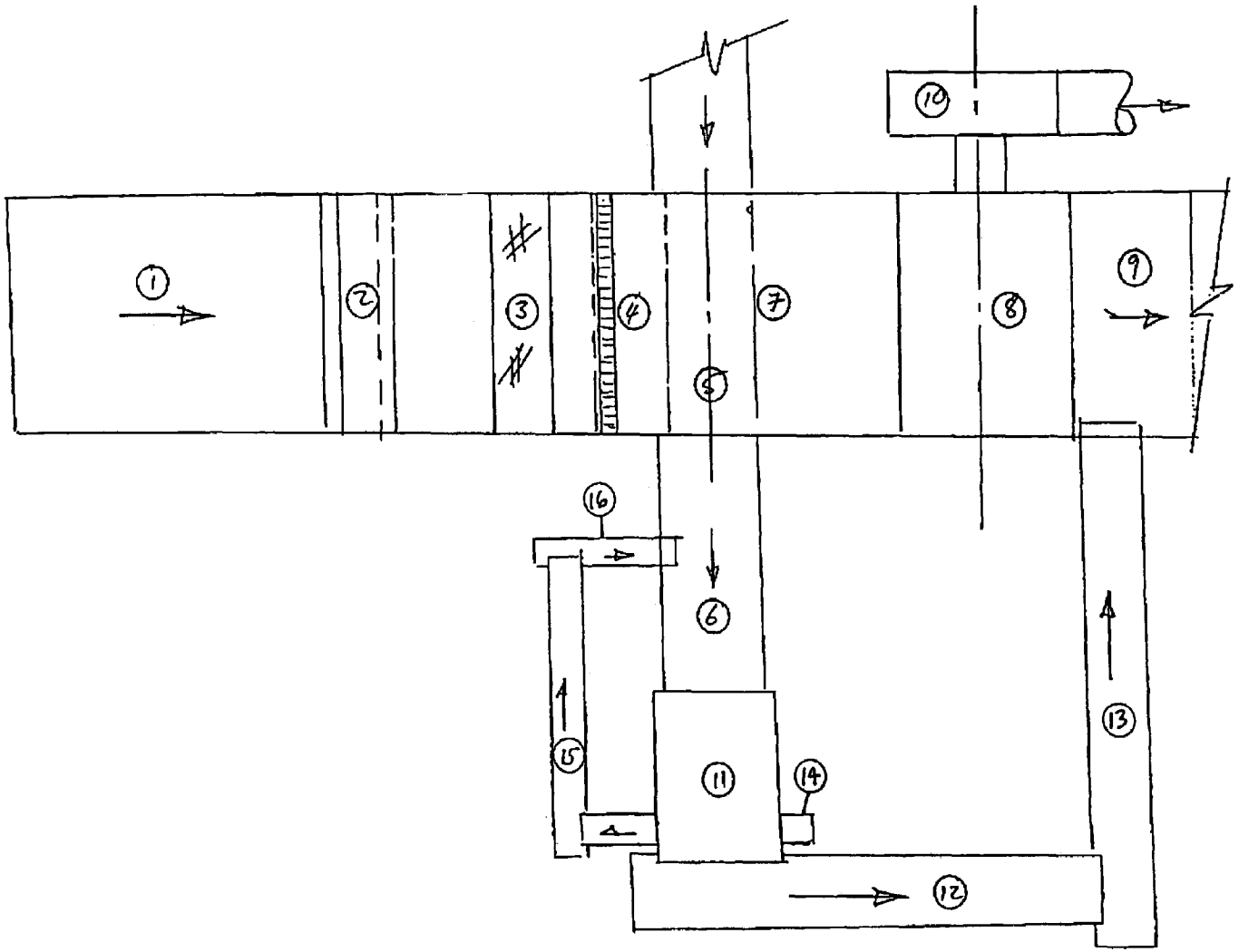
FIG. 2 is a plan view of the apparatus of FIG. 1.

Some acceptable leaves are rejected with the unacceptable leaves and particles. Referring to FIG. 2, the rejected leaves and/or particles are combined and delivered by the second conveyor 6 to a second scanning device 11, which may be a standard commercially available scanning device arranged and configured to scan the leaves on the second conveyor. The rejected leaves and/or particles undergo a second sorting to remove the unacceptable leaves and/or particles from the acceptable leaves. The unacceptable leaves and/or particles are removed from a third conveyor 14, for example by hand, and any remaining leaves are sent back to the second conveyor 6 by fourth and fifth conveyors 15 and 16 and through the second scanning device 11. The acceptable leaves detected by the second scanning device 11 are sent back to the flow of tobacco leaves by sixth and seventh conveyors 12 and 13. The acceptable leaves are sent back to the flow of tobacco leaves at a point after the chute 21.

The tobacco leaves in the flow in the duct 20 that pass the scanning device 3 are unloaded by a cyclonic device 8 via an airlock 22 and fall onto a fifth conveyor 9. The tobacco leaves are recombined with the acceptable tobacco leaves from the fourth conveyor 12 and proceed to further processing. The cyclonic device 8 is aspirated by a centrifugal fan 10 and the exhaust air is cleaned, for example by a bag filter unit, before being discharged to the atmosphere.

Currently available scanning devices are fed leaves at speeds between 600 and 1,000 ft/min. This would be impractical to scan whole leaves because of their size and volume. There would be many shadows and the number of acceptable leaves that would be rejected would be unacceptably high. By dispersing the leaves in a flow in the duct at a velocity of 4000-6000 ft/min, each leaf will be separated from those around it and can accepted or rejected separately. By scanning from opposing sides (e.g., the top and bottom) of the flow, any unacceptable leaf will be visible to the scanning device(s). As it is not necessary to reject very small particles at this stage of the tobacco leaf processing, the speed necessary to separate the individual leaves is acceptable even if very small particles are not detectable. Laser scan speeds are in the range of 2,000-12,000 scans/sec. At 6,000 ft/min, and 2,000 scans/sec, a scan will cross the flow every 0.6 inches, which provides acceptable results. At 6,000 ft/min and 12,000 scans/sec, a scan will cross the flow every 0.1 inches, which provides even more acceptable results. It should be appreciated that other combinations of flow velocities and scan speeds are possible.

Figure 3:
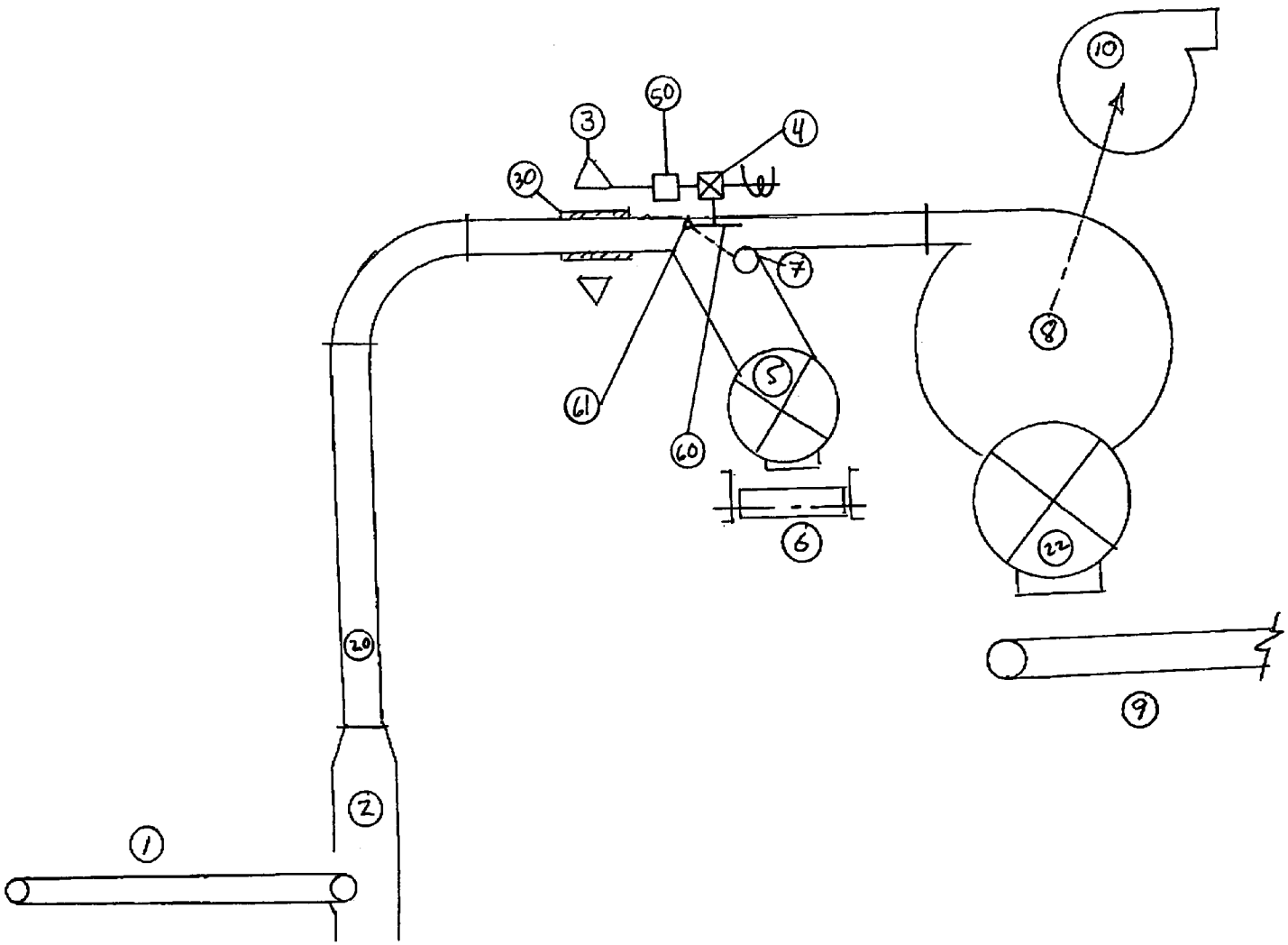
FIG. 3 is a side elevation view of an apparatus for scanning and sorting tobacco leaves according to another exemplary embodiment of the present invention.

Referring to FIG. 3, an apparatus according to another exemplary embodiment includes a flap 60 pivotably attached to the duct 20 by, for example, a spring biased hinge 61, at a position proximate the chute 21. Upon detection of an unacceptable leaf and/or particle by the scanning device 3, a signal is sent from the scanning device 3 to the control device 50. The control device 50 actuates a solenoid (or solenoids) 4 to cause the plunger of the solenoid 4 to extend and pivot the flap 60 against the bias of the hinge 61 from the position shown in solid line to the position shown in dashed line. At the position shown in dashed line, the flap 60 directs unacceptable leaves and/or particles into the chute 21.

Although the flap 60 is shown in a horizontal portion of the duct 20, it may be provided at an angled portion or a vertical portion of the duct. It should also be appreciated that the flap need not be pivoted, and may be linearly actuated into a position to direct unacceptable leaves and/or particles into the chute 21, or the flap may be provided as a vane in the duct in a manner similar to a throttle valve so as to direct leaves and/or particles out of the duct. It should further be appreciated that actuation devices other than a solenoid or solenoids may be used to actuate the flap into a position to direct unacceptable leaves and/or particles into the chute 21. For example, a compressed air source may be used to actuate the flap into position.

Although certain exemplary embodiments of the present invention have been described, it will be appreciated that variations and modifications of the present invention may be made without departing from the scope of the invention.

What is claimed is:

1. An apparatus for scanning and sorting tobacco leaves, comprising:

a conveyor configured to convey a flow of tobacco leaves, the flow of tobacco leaves including acceptable tobacco leaves, unacceptable tobacco leaves and undesirable particles;

an air flow source configured to lift and accelerate the flow of tobacco leaves to a speed at which the tobacco leaves and particles are separated;

a duct configured to contain the lifted and accelerated flow of tobacco leaves and particles;

a scanning device configured to scan the flow of tobacco leaves in the duct and generate a signal upon detection of at least one of an unacceptable tobacco leaf and an undesirable particle; and a rejection device responsive to the signal and configured to force unacceptable tobacco leaves and undesirable particles from the duct.

2. An apparatus according to claim 1, wherein the duct extends vertically with respect to the conveyor.

3. An apparatus according to claim 2, wherein the duct includes opposing transparent portions and the scanning device is positioned to scan the flow at the transparent portions.

4. An apparatus according to claim 1, wherein the rejection device comprises at least one solenoid valve configured to receive the signal and release compressed air from a compressed air source upon receipt of the signal to force the unacceptable tobacco leaves and the undesirable particles from the duct.

5. An apparatus according to claim 1, further comprising a chute connected to the duct and configured to receive the unacceptable tobacco leaves and the undesirable particles forced from the flow.

6. An apparatus according to claim 5, further comprising a roller positioned at a juncture of the duct and the chute and rotatable to move the unacceptable tobacco leaves and the undesirable particles at the juncture into the chute.

7. An apparatus according to claim 5, further comprising an airlock configured to receive the unacceptable tobacco leaves and the undesirable particles forced from the chute.

8. An apparatus according to claim 7, further comprising a second conveyor configured to receive the unacceptable tobacco leaves and the undesirable particles from the airlock.

9. An apparatus according to claim 8, further comprising a second scanning device configured to scan the tobacco leaves and the particles conveyed by the second conveyor to detect unacceptable tobacco leaves and undesirable particles.

10. An apparatus according to claim 9, further comprising a third conveyor configured to convey unacceptable tobacco leaves and undesirable particles detected by the second scanning device.

11. An apparatus according to claim 10, further comprising a fourth conveyor configured to convey acceptable tobacco leaves passing the second scanning device.

12. An apparatus according to claim 1, further comprising a cyclonic device configured to unload tobacco leaves from the duct that pass the rejection device.

13. An apparatus according to claim 12, further comprising an airlock configured to receive tobacco leaves from the cyclonic device.

14. An apparatus according to claim 12, further comprising a fan configured to aspirate the cyclonic device.

15. An apparatus according to claim 13, further comprising a second conveyor configured to convey tobacco leaves from the airlock.

16. An apparatus according to claim 1, wherein the flow of tobacco leaves conveyed by the conveyor to the air flow source is approximately one to two inches thick.

17. An apparatus according to claim 16, wherein the air flow source accelerates the tobacco leaves to a speed of approximately 4,000 to 6,000 ft/min.

18. An apparatus according to claim 1, wherein the scanning device is a laser scanning device or an optical scanning device.

19. An apparatus according to claim 17, wherein the scanning device scans the flow of tobacco leaves approximately 2,000-12,000 times per second.

20. An apparatus according to claim 1, wherein the scanning device is configured to scan the flow from opposing sides of the flow.

21. An apparatus according to claim 1, further comprising a control device configured to control actuation of the rejection device.

22. An apparatus according to claim 21, wherein the control device is programmable and controls the actuation of the at rejection device based on the speed of the leaves and an actuation time of the rejection device.

23. An apparatus according to claim 1, wherein the rejection device comprises a flap selectively insertable into the flow of leaves and particles in response to the signal from the scanning device to direct unacceptable leaves and undesirable particles from the duct.

24. An apparatus according to claim 23, wherein the flap is pivotably connected to the duct.

25. An apparatus according to claim 24, wherein the rejection device further comprises a solenoid actuable in response to the signal from the scanning device to pivot the flap into the flow of leaves and particles.

* * * * *